US006420683B1

(12) United States Patent
Chiba et al.

(10) Patent No.: US 6,420,683 B1
(45) Date of Patent: Jul. 16, 2002

(54) GLOW PLUG WITH NI-FE-CO RESISTOR

(75) Inventors: Yukifumi Chiba, Osaka; Hisashi Higuchi, Hyogo; Chiaki Kumada, Gifu; Shunsuke Gotou, Aichi, all of (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 09/957,028

(22) Filed: Sep. 21, 2001

(30) Foreign Application Priority Data

Sep. 26, 2000 (JP) ..... 2000-292982

(51) Int. Cl.[7] ..... F23Q 7/00

(52) U.S. Cl. ..... 219/270; 219/544; 219/553; 123/145 A

(58) Field of Search ..... 219/270, 544, 219/553, 542, 546, 547, 548, 505; 123/145 A, 145 R; 338/22 R, 243

(56) References Cited

U.S. PATENT DOCUMENTS

| | | | |
|---|---|---|---|
| 5,091,631 A | | 2/1992 | Dupuis et al. |
| 5,093,555 A | | 3/1992 | Dupuis et al. |
| 5,319,180 A | | 6/1994 | Locher et al. |

FOREIGN PATENT DOCUMENTS

| | | | |
|---|---|---|---|
| DE | 40 29 185 A1 | | 3/1992 |
| EP | 391719 | * | 10/1990 |
| EP | 749 133 A2 | | 12/1996 |
| JP | 58-83124 | | 5/1983 |
| JP | 5-105990 | * | 4/1993 |
| JP | 9-148049 | * | 6/1997 |

* cited by examiner

*Primary Examiner*—John A. Jeffery
(74) *Attorney, Agent, or Firm*—Sughrue Mion, PLLC

(57) ABSTRACT

The invention provides a glow plug with an electric resistor made of a material comprising 20 to 60% by weight nickel and less than 5% by weight iron and the balance of cobalt and unavoidable impurities. The glow plug pf the invention attains an excellent quick heating ability, a self-temperature control function, high oxidation resistance, long durability and good workability.

7 Claims, 3 Drawing Sheets

GLOW PLUG WITH NI-FE-CO RESISTOR

BACKGROUND OF THE INVENTION

The present invention relates to a glow plug, particularly of the kind for use in a diesel engine.

A glow plug for a diesel engine has an electric resistor or electric resistors, e.g., of coil type for performing a heating function and a temperature control function.

Research has been made on resistive material for such an electric resistor or electric resistors, which contains iron-group metals (i.e., iron, nickel and cobalt) as major components. This kind of resistive material has a positive temperature characteristic for electrical resistance so that the ratio of the electrical resistance at room temperature to the electric resistance at elevated temperature (hereinafter referred to as the resistance ratio) rises up with an increase in the temperature of the resistive material.

An example of such resistive material is disclosed in Japanese Laid-Open Patent Publication No. 58-83124 (JP-A-58-83124). According to JP-A-58-83124, a preheating plug has a heating resistance unit made of a Fe—Ni—Co alloy that comprises 40 to 70% by weight cobalt, 2 to 15% by weight nickel and the remainder of iron. As shown in FIG. 1 of JP-A-58-83124, the Fe—Ni—Co alloy has a resistance ratio that rapidly rises with temperature increase up to about 900° C., and attains a good quick heating ability with toughness.

Another example of the resistive material is disclosed in U.S. Pat. No. 5,093,555. In accordance with U.S. Pat. No. 5,093,555, an electrical resistance element is made of a Fe—Ni—Co alloy essentially consisting of 20 to 35% by weight iron and the remainder of nickel and cobalt. In FIG. 1 of U.S. Pat. No. 5,093,555, the resistance ratios of iron and nickel are indicated by curves 4 and 5, respectively. As nickel has a lower Curie temperature than iron, the resistance ratio of nickel starts to settle down at a lower temperature around 400° C. than that of Iron. Further, the resistance ratio of another alloy (i.e., a Fe—Co alloy) is shown in FIG. 1A of U.S. Pat. No. 5,093,555. This Fe—Co alloy contains 25% by weight iron, and has a resistance ratio that starts to increase rapidly at around 800° C. and starts to settle down at around 900° C. On the other hand, a family of Fe—Ni—Co alloys defined by U.S. Pat. No. 5,093,555 has resistance ratios as indicated by curves 1, 2 of FIG. 1 and curve 3 of FIG. 3. Each of the Fe—Ni—Co alloys exhibits a hysteresis curve in its resistance ratio-temperature characteristic so that the resistance ratio rises up to about 1000° C. and starts to settle down at around 1000° C. In other words, the Fe—Ni—Co alloy defined by U.S. Pat. No. 5,093,555 can attain a good quick heating ability up to about 1000° C. and can perform a fine temperature control function from about 1000° C.

Still another example is disclosed in U.S. Pat. No. 5,319,180. In accordance with U.S. Pat. No. 5,319,180, a sheathed-element glow plug has a resistor element composed of two resistor spirals. One of the resistor spirals performs a temperature control function, and is made of a Fe—Co alloy containing 6 to 18% by weight iron (preferably, 12 to 14 % by weight iron), 81 to 94% by weight cobalt and any remainder not exceeding 1% by weight. This Fe—Co alloy maintains a face-centered cubic material structure throughout an operating temperature range of the glow plug so that the resistor spiral is not broken.

SUMMARY OF THE INVENTION

From growing awareness of environmental concerns in the recent years, it has become necessary to keep heating the glow plug for a longer time than before, after the starting of the diesel engine, so that exhaust gas from the engine becomes cleaner. It is therefore being demanded that the resistive material of the electric resistor attains not only a quick heating ability and a self-temperature control function but also high durability. However, any conventional resistive material disclosed in e.g., the above patent documents is easily oxidized due to its relatively high iron content. Namely, the conventional resistive material does not have enough oxidation resistant for long-time heating.

In addition, the resistive material with its high cobalt content has come Into use, particularly for the electric resistor that performs the temperature control function, as disclosed in the above patent documents. However, when the resistive material contains a relatively large amount of cobalt, its workability becomes lowered. It is therefore difficult to shape the material into a finer wire, especially by cold-working, to be used as the electric resistor of coil type. This results in failure to meet an increasing demand of downsizing the glow plug.

In view of the foregoing, the present invention has been made to provide a glow plug with an electric resistor, which is free from the above-described drawbacks and can satisfy the following requirements [1] to [3] adequately.

[1] The electric resistor has a high resistance ratio so that the glow plug can attains an excellent quick heating ability.

[2] The electric resistor has high oxidation resistance so that the glow plug has a long life even when used for long-time heating.

[3] The electric resistor can be shaped into a fine wire so that the glow plug can be downsized.

To achieve the above objects, the invention provides a glow plug having an electric resistor that comprises 20 to 60% by weight nickel, less than 5% by weight iron, and the balance being cobalt and unavoidable impurities.

BRIEF DESCRIPTION OF THE DRAWINGS

The invention will be more clearly understood from the following description, given by way of example only, with reference to the accompanying drawings in which.

DETAILED DESCRIPTION OF THE PREFERRED EMBODIMENTS

A glow plug according to the invention has an electric resistor made of a material comprising 20 to 60% by weight nickel, less than 5% by weight iron, and the balance being cobalt and unavoidable impurities, based on the total weight of the material. As intended by the invention, the electric resistor can serve as a heating coil and/or a control coil when the glow plug is structured as e.g., the following embodiments.

Figure 1:
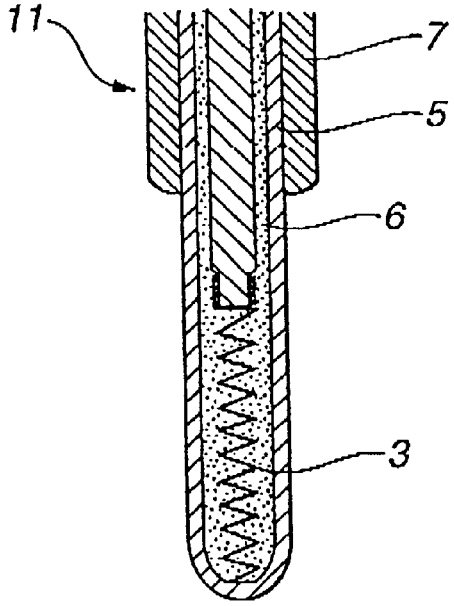
FIG. 1 is a sectional view of a glow plug for a diesel engine, comprising a single coil (i.e., a heating/control coil) according to a first embodiment of the invention.

The structures of glow plugs 11 to 13 according to first to third of the invention will be described with reference to FIGS. 1 to 3, respectively. Herein, like parts and components are designated by the same reference numerals to avoid duplicating the description.

The glow plug 11 of the first embodiment comprises a sheathed tube 5 (hereinafter referred to as a tube) made of, e.g., stainless steel or Inconel (Inconel is trade name), and a heating/control coil 3 arranged within the tube 5. The heating/control coil 3 combines two functions: one is a heating function and the other is a temperature control function. The heating/control coil 3 has low electrical resistance in the initial stage of energization, so that the heating/control coil 3 is supplied with relatively large electricity and is heated rapidly to a higher temperature. During the heating, the electrical resistance of the heating/control coil 3 increases due to its positive temperature coefficient of resistance, thereby regulating the electricity. As a consequence, the temperature of the glow plug 11 settles down to a saturated temperature.

The glow plug 12 of the second embodiment comprises a tube 5, a heating coil 1 arranged in a front-end portion within the tube 5, and a control coil 2 electrically connected in series to the heating coil 1 within the tube 5. In this structure, the heating coil 1 and the control coil 2 perform a heating function and a temperature control function, respectively.

The glow plug 13 of the third embodiment comprises a tube 5, a heating coil 1, a control coil 2, and a coil 4 arranged between the heating coil 1 and the control coil 2 within the tube 5. The coil 4 prevents electricity supply from being regulated in the initial stage of energization.

In each of the glow plugs 11 to 13, the tube 5 is filled. with an electrical insulating material 6 of, e.g., magnesia (MgO), so that each coil is buried and fixed therein. Each of the glow plugs 11 to 13 further comprises a fitting 7 for retaining the tube 5.

As mentioned above, a glow plug is required to provide quick heating performance and to keep its operating temperature at a saturation temperature after the heating. In other words, it is demanded that the material for the electric resistor of the glow plug has a quick heating ability and a self-temperature control function. The quick heating ability and the self-temperature control function can be achieved by the following characteristic of the material: the electrical resistance is low at a low temperature in the initial stage of energization so that the material is supplied with relatively large electricity, and then, the electrical resistance rises rapidly with temperature increase so that the material is supplied with smaller electricity. A high-performance glow plug can be provided with an electric resistor made of a material having such characteristics.

In addition, in order to use such a material for the electric resistor of coil type, the material needs to be shaped into a fine wire of a diameter of several hundred $\mu$m . When the material is of a hexagonal cobalt-containing alloy, it is hard to shape the material into a fine wire of the above diameter, especially by cold-working. However, the workability of the material can be improved by changing its crystal structure from an unworkable hexagonal crystal structure to an easily workable cubic crystal structure.

Accordingly, when the material of the electric resistor comprises less than 20% by weight nickel, the workability of the material becomes so low that the material cannot be shaped into a fine wire of a diameter of several hundred $\mu$m by cold-working. On the other hand, when the material comprises more than 60% by weight nickel and not less than 5% by weight iron, the oxidation resistance of the material becomes low, at the same time, the resistance ratio of the material becomes too small to attain an adequate quick heating ability. It is therefore essential, according to the invention, that the material comprises 20 to 60% by weight nickel, less than 5% by weight iron and the balance of cobalt and unavoidable impurities so as to attain an excellent quick heating ability, high oxidation resistance and good workability.

Also, the material according to the invention does not change its volume rapidly due to $\alpha/\gamma$ phase conversion during the heating as often observed in conventional Fe—Co alloys. This makes it possible to prevent the breaking of electric resistor from occurring.

Further, the material according to the invention has a cubic crystal structure. Therefore, the workability of the material can be highly improved so that the material can be easily shaped into a fine wire by cold-working.

Figure 2:
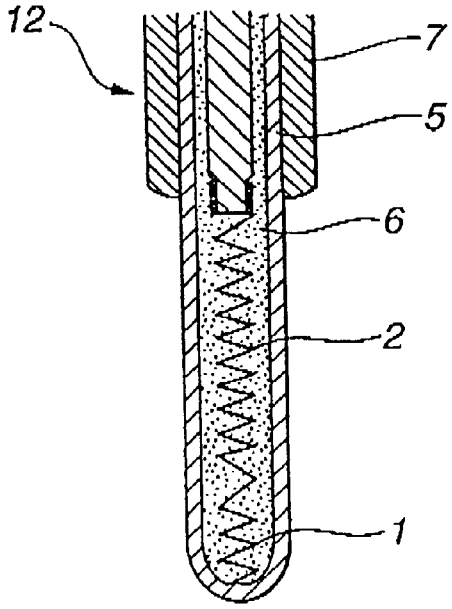
FIG. 2 is a sectional view of a glow plug for a diesel engine, comprising two coils (i.e., a heating coil and a control coil) according to a second embodiment of the invention.
Figure 3:
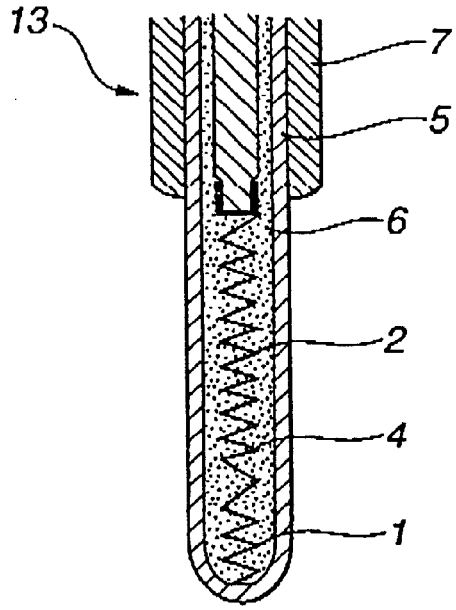
FIG. 3 is a sectional view of a glow plug for a diesel engine, comprising three coils (i.e., a heating coil, a control coil and an additional coil) according to a third embodiment of the invention.

In the case where the glow plug of the invention is structured as shown in FIG. 2 or 3, it may be necessary to connect the electric resistor to another electric resistor of a different material by welding. As the material according to the invention has high oxidation resistance, it is not easily oxidized during the welding, i.e., provides good weldability.

Particularly, it is preferable to satisfy the following equation: $X+7Y \leqq 70$, in which X and Y are the contents of nickel and of iron in terms of % by weight in the above-mentioned composition of the material. When this equation is satisfied (e.g., the content of nickel increases with decrease in the content of iron), the material can attain particularly high oxidation resistance.

Herein, for explanation purpose, a first composition is defined as comprising 20 to 60% by weight nickel and less than 5% by weight iron. Also, a second composition is herein defined as satisfying the equation: $X+7Y \leqq 70$ within the first composition.

Figure 4:
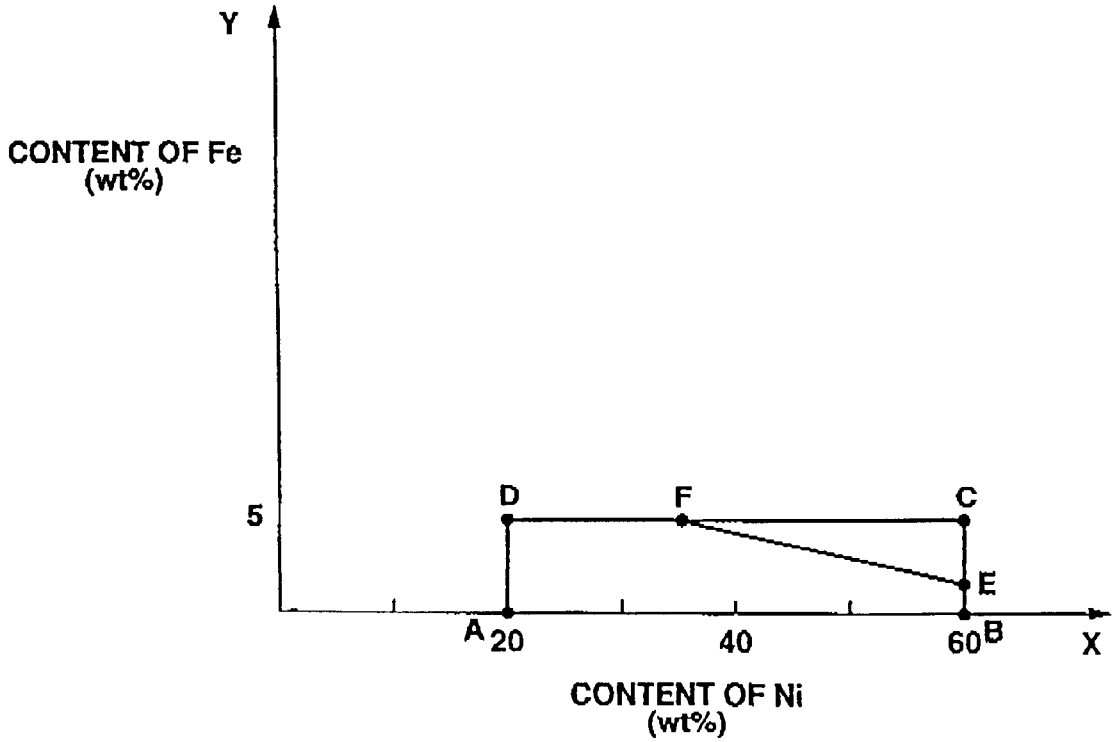
FIG. 4 is a composition diagram of materials for electric resistors according to the invention.

The first and the second compositions are indicated in FIG. 4. as described below. It is noted that vertical and horizontal axes of FIG. 4 represent the contents of iron and of nickel in terms of % by weight, respectively, but are not on the same scale. The first composition corresponds to an area within a rectangular area defined by apexes A; B, C and D, except for a line CD, in FIG. 4, The second composition corresponds to an area within a pentagonal area defined by apexes A, B, E, F and D, except for a line DF, in FIG. 4. The coordinate values of the apexes A, B, C, D, E, F, indicative of (the content of iron, the content of nickel), are (20, 0), (60, 0), (60, 5), (20, 5), (60, 1.43) and (35, 5), respectively, in terms of % by weight.

In order to achieve suitable oxidation resistance in addition to a suitable resistance ratio for the electric resistor of the glow plug, it is desirable that the material of the electric resistor contains a less amount of iron. On the other hand, when the material contains a less amount of iron, its workability becomes lowered.

Further, the material of the electric resistor is oxidized from its surface, thereby causing an increase in the electrical resistance with progress in oxidation. In the case where the material is shaped into a finer wire, such an increase in the electrical resistance becomes remarkable.

However, when the material of the invention has the second composition, it becomes possible to maintain the resistance ratio of the material appropriately without deteriorating the workability, at the same time, becomes possible to highly improve the oxidation resistance of the material. As a result, the material of the second composition is oxidized especially slowly from its wire surface, and its electrical resistance increases only slightly with the process in oxidation. That is, the material of the second composition can be made more durable (i.e., have a longer life), particularly than any conventional material shaped into a wire of the same diameter. Even when the material of the second composition is shaped into a finer wire, the glow plug can attain a sufficiently long life. This leads to the downsizing of the glow plug.

Moreover, the material according to the invention is usable not only for a control coil but also for a heating coil due to its high oxidation resistance. The electric resistor of the invention can combine a heating function with a temperature control function. as illustrated in FIG. 1.

A relationship between the compositions and the abilities of the material can be summarized as follows with reference to FIG. 4. The material of the first composition can attain an excellent quick heating ability, long durability and good workability. The material of the second composition can attain a more excellent quick heating ability and longer durability. When the material has a composition defined by a triangular area with apexes C, E and F. the material does not attain so good quick heating ability and so high durability as the material of the second composition does.

The unavoidable impurities, contained in the material according to the invention. may include carbon, silicon. titanium. manganese, chrome, aluminum, boron and/or bismuth. It is preferred that carbon is contained in an amount of 0.1% by weight or less, and that silicon, titanium, manganese, chrome, aluminum, boron and bismuth are contained in an amount of 0.1% by weight or less in total. When the material contains more than the above amounts of these unavoidable impurities. there is a tendency that the workability of the material is often deteriorated.

Furthermore, the material according to the invention may additionally comprise up to 3% by weight vanadium and up to 3% by weight tungsten, or may additionally comprise up to 8% by weight molybdenum. Preferably, the material of the invention may comprise up to 3% by weight vanadium, up to 3% by weight tungsten and up to 8% by weight molybdenum. The material with the above-mentioned vanadium, tungsten and/or molybdenum contents has higher thermal resistance and higher oxidation resistance (e.g., higher strength at elevated temperature and higher creep strength), while maintaining an excellent quick heating ability and a self-temperature control function.

It is also preferred that a resistance ratio of $\rho(1000)/\rho(20)$ falls within a range from 7 to 12, in which $\rho(20)$ and $\rho(1000)$ are the electrical resistance of the material at 20° C. (i.e., room temperature) and at 1000° C., respectively. When the resistance ratio of $\rho(1000)/\rho(20)$ is equal to or greater than 7 and the temperature coefficient of resistance of the material monotonously increases from room temperature to a temperature about 800° C., it becomes easier to regulate electricity supply to the electric resistor effectively. The temperature of the electric resistor can be therefore controlled finely.

Although it is desirable that the material of the electric resistor has a higher resistance ratio to improve its quick heating ability and self-temperature control function, the resistance ratio of $\rho(1000)/\rho(20)$ hardly becomes larger than 12 according to the invention. It is because the invention has been made so as to improve the oxidation resistance and workability of the material as well as to attain the quick heating ability and self-temperature control function. The conventional resistive material recited in, e.g., JP-A-58-83124 and U.S. Pat. No. 5,093,555 may have a resistance ratio of $\rho(1000)/\rho(20)$ greater than 12, but such resistive material is lower in oxidation resistance than the material of the invention due to its iron and nickel contents.

The invention will be specifically illustrated in more detail by way of the following examples.

EXAMPLE 1

Samples 1 to 7 (materials having a variety of compositions according to the invention) and Samples 9 to 12 (materials of comparative examples) were given by the following procedures, respectively. The components listed in TABLE 1 were dissolved within an induction heater in a vacuum and were cast into a casting mold of a diameter of 25 mm, thereby obtaining a cast alloy. The surface of the cast alloy was removed by cutting for the purpose of removing surface deficiencies caused during the casting. Then. the cast alloy was formed into a wire of a diameter of 10 mm by hot-casting. The wire was treated with heat at 900° C. for 1 hour. While repeating cold-wiring and heat-treating, the cast alloy was formed in a wire of a predetermined diameter of 0.15 to 0.35 mm. The cast alloy of Samples 9 and 11 were found to be unworkable into such thin wires. Sample 8 (comparative example) was a wire given by coating a commercially available steel wire with nickel. Sample 10 (comparative example) was a commercially available nickel wire.

Figure 5:
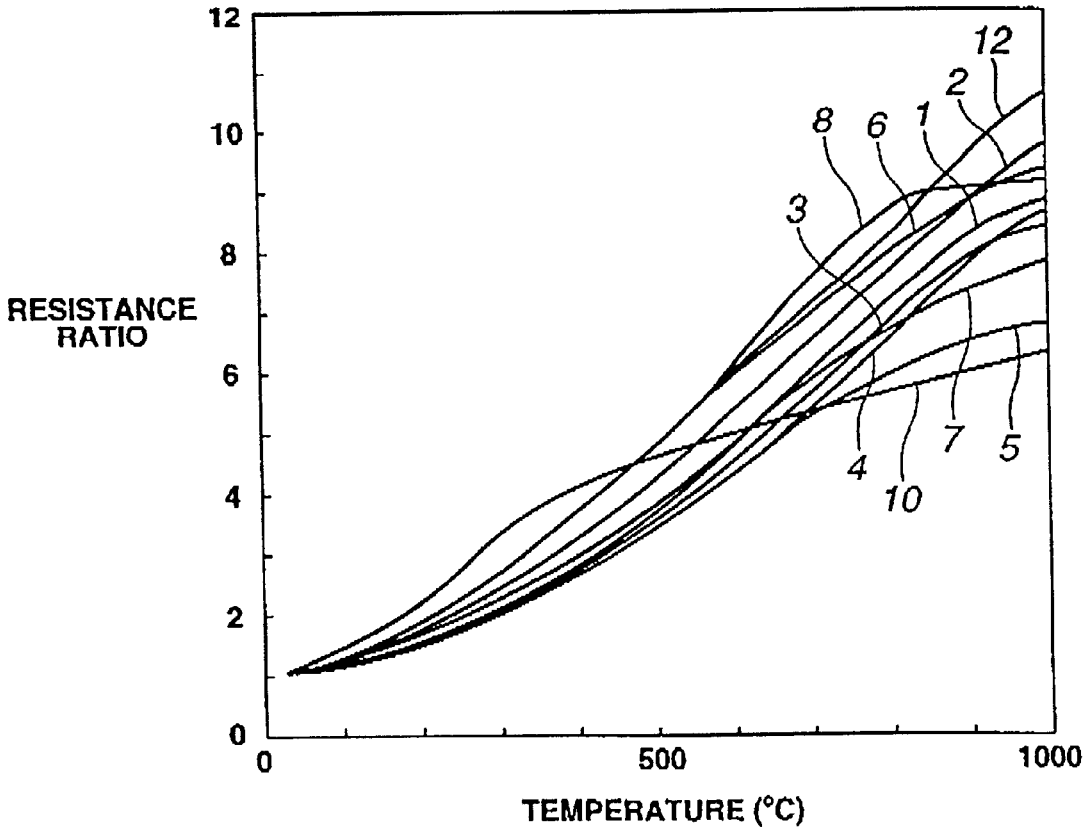
FIG. 5 is a graph showing resistance ratio-temperature characteristics of materials used for electric resistors according to embodiments of the invention and to comparative examples.

For each of Samples 1 to 8, 10 and 12, the resistance ratio between the electrical resistance at 20° C. (i.e., room temperature) and the electrical resistance at 1000° C., the temperature coefficient of resistance, the limit workability in cold-working and the oxidation resistance were evaluated. The evaluation results are indicated in TABLE 1. Also, the resistance ratio-temperature characteristics are indicated in FIG. 5 for Samples 1 to 8, 10 and 12. Samples 9 and 11 were left out from the evaluation, because those samples were found to be unworkable as described above.

In TABLE 1, the temperature coefficient of resistance was marked as follows.

A: The temperature coefficient of resistance monotonously increases over the range from room temperature up to at least 800° C.

B: The temperature coefficient of resistance decreases at a temperature lower than 800° C.

Further, in TABLE 1, "OTHER" under the heading of "COMPOSITION" refer to silicon, titanium, manganese, chrome, aluminum, boron and bismuth, and their total content is indicated for each sample.

The resistance ratio was defined as $\rho(1000)/\rho(20)$, where $\rho(20)$ is the electrical resistance at 20° C. and $\rho(1000)$ is the electrical resistance at 1000° C.

The oxidation resistance was examined after placing each sample in the air at 900° C. for 50 hours and was rated as follows in TABLE 1.

A; Very High

B: High

C: A Little Low

D: Low

As is apparent from TABLE 1 and FIG. 5, it has been found that Samples 1 to 7 according to the invention attain good workability, high resistance ratio and high oxidation resistance. Namely, any of Samples 1 to 7 is suitable for the electric resistor of the glow plugs Herein, Sample 7 does not satisfy the equation: $X+7Y \leqq 70$, as $X+7Y$ equals 78 (i.e., is over 70). Thus, Sample 7 had a little lower resistance ratio than Samples 1 to 6. Further, the temperature coefficient of resistance of Sample 7 decreases at a lower temperature (about 700° C.) than those of Samples 1 to 6.

Sample 12, containing 8% by weight iron, was good at workability, but was a little low in oxidation resistance. On the other hand, Sample 9, containing 4% by weight iron with no nickel, was better at oxidation resistance than Sample 12, but was so low in workability that it was unable to be cold-worked. Based on the comparison between Samples 9 and 12, it has been understood that the material for the electric resistor needs to comprise a predetermined amount of nickel therein.

temperature of the glow plug to 800° C. is just referred to as the time to reach 800° C.) Subsequently supplying the direct-current voltage of 11 V, the surface temperature of the glow plug was measured after 30 seconds from the time to reach 800° C. as the basis for self-temperature control function. (Hereinafter, the surface temperature of the glow plug after 30 seconds from the time to reach 800° C. is just referred to as the temperature after 30 sec.)

Further, what is so called, heat cycle examination was performed to evaluate durability. In one cycle of this heat cycle examination, the glow plug was energized with a direct-current voltage of 13 V for 300 seconds, and then, cooled by shutting off electricity for 60 seconds. In TABLE 2, the durability was rated as follows for each of the embodiments and the comparative examples.

A: The control coil did not break while repeating 5000 cycles of the heat cycle examination.

TABLE 1

| SAMPLE NO. | COMPOSITION (wt %) Ni | Fe | Co | V | W | Mo | IMPURITIES C | OTHERS | RESISTANCE RATIO | TEMPERATURE COEFFICIENT OF RESISTANCE | LIMIT WORKABILITY (%) | OXIDATION RESISTANCE |
|---|---|---|---|---|---|---|---|---|---|---|---|---|
| EXAMPLES | | | | | | | | | | | | |
| 1 | 40 | — | (r) | — | — | — | 0.04 | 0.07 | 8.9 | A | 90 | A |
| 2 | 25 | 4 | (r) | — | — | — | 0.02 | 0.08 | 9.8 | A | 92 | B |
| 3 | 45 | 2 | (r) | 1.5 | 1.1 | 5.0 | 0.06 | 0.04 | 8.5 | A | 88 | A |
| 4 | 40 | 4 | (r) | — | — | — | 0.02 | 0.02 | 8.7 | A | 93 | B |
| 5 | 55 | 1 | (r) | 3.3 | 1.6 | 4.5 | 0.03 | 0.08 | 6.7 | B | 86 | A |
| 6 | 25 | 2 | (r) | — | — | — | 0.15 | 0.03 | 9.5 | A | 75 | A |
| 7 | 50 | 4 | (r) | — | — | — | 0.03 | 0.05 | 7.9 | B | 90 | B |
| COMPARATIVE EXAMPLES | | | | | | | | | | | | |
| 8 | (steel wire coated with nickel) | | | | | | | | 9.2 | B | — | D |
| 9 | — | 4 | (r) | — | — | — | 0.02 | 0.03 | — | — | unworkable | — |
| 10 | 100 | — | — | — | — | — | — | — | 6.3 | B | 99 or more | A |
| 11 | 10 | 4 | (r) | — | — | — | 0.02 | 0.26 | — | — | unworkable | — |
| 12 | — | 8 | (r) | — | — | — | 0.02 | 0.04 | 10.7 | A | 92 | C |

The content of Co is marked "(r)" in TABLE 1, indicating that the composition except for Ni, Fe, V, W, Mo and impurities was balanced with Co in each sample.

EXAMPLE 2

Glow plugs of Embodiments 101 to 104 according to the invention and of Comparative Examples 105 to 107 were produced as described below. In each of the examples and the comparative examples, the glow plug was structured to have two coils, i.e., a heating coil and a control coil in a tube with an electrical insulating powder, as shown in FIG. 2. The tube was made of SUS 310S or Inconel 601, and was sealed at its one end. The electrical insulating powder was of magnesia powder. The heating coil was made of a Fe—Co alloy or a Ni—Cr alloy as shown in TABLE 2. The control coil was made by shaping the sample listed in TABLE 2, which had been given in Example 1 and formed as a wire of 0.15 to 0.35 mm in diameter, into a coil form without heating.

Then, while supplying each of the glow plugs of the embodiments and of the comparative examples with a direct-current voltage of 11 V, the time required to raise the surface temperature of the glow plug from room temperature to 800° C. was measured as the basis for quick heating ability. (Hereinafter, the time required to raise the surface B: The control coil broke in process of 5000 cycles of the heat cycle examination.

Also, weldability between the control coil and the heating coil was evaluated as follows.

A: Phase conversion did not occur in a welding portion between the control coil and the heating coil.

B: Phase conversion was difficult to occur due to the presence of nickel in the control coil, although iron contained in the heating coil was distributed into the welding portion during the heating.

C: $\alpha/\gamma$ phase conversion was easy to occur due to the distribution of iron from the heating coil into the welding portion during the heating.

It has become apparent from TABLE 2 that the glow plugs of the Embodiments 101 to 104 attain higher durability. That is, the glow plugs of the Embodiments 101 to 104 according to the invention have longer lives and are more reliable than the comparative examples.

TABLE 2

| | MATERIALS | | TIME TO REACH | TEMPERATURE | | |
|---|---|---|---|---|---|---|
| | HEATING COIL | CONTROL COIL | 800° C. (sec) | AFTER 30 sec (° C.) | DURABILITY | WELDABILITY |
| EMBODIMENT | | | | | | |
| 101 | Fe—Cr Alloy | Sample No. 1 | 4.5 | 980 | A | B |
| 102 | Fe—Cr Alloy | Sample No. 2 | 4.5 | 980 | A | B |
| 103 | Ni—Cr Alloy | Sample No. 1 | 5.0 | 960 | A | A |
| 104 | Ni—Cr Alloy | Sample No. 2 | 5.0 | 960 | A | A |
| COMPARATIVE EXAMPLE | | | | | | |
| 105 | Fe—Cr Alloy | Sample No. 8 | 4.5 | 980 | B | B |
| 106 | Ni—Cr Alloy | Sample No. 8 | 5.0 | 960 | B | A |
| 107 | Fe—Cr Alloy | Sample No. 12 | 4.5 | 980 | A | C |

EXAMPLE 3

Glow plugs of Embodiments 201 and 202 according to the invention and of Comparative Example 203 were manufactured based on Example 2. In each of the embodiments and the comparative example, the glow plug was configured to have three coils, i.e., a heating coil, a control coil and a coil between the heating coil and the control coil in, as shown in FIG. 3. The heating coil was made of a Fe—Cr alloy, while the control coil was made of the sample listed in TABLE 3 that had been given in Example 1. The coil between the heating coil and the control coil was made of pure nickel, which is low in electrical resistance.

The glow plugs of Embodiments 201 and 202 and of Comparative Example 203 were evaluated in the same manner to Example 2. The evaluation results are indicated in TABLE 3.

As is apparent from TABLE 3, the glow plugs of Embodiments 201 and 202 according to the invention are also found to have longer lives and to be more reliable than the comparative example.

EXAMPLE 4

Glow plugs of Embodiments 301 and 302 according to the invention and of Comparative Example 303 were manufactured based on Example 2. In each of the embodiments and the comparative example, the glow plug was configured to have a single coil (i.e., a heating/control coil), as shown in FIG. 1. The heating/control coil was made of the sample listed in TABLE 4 that had been given in Example 1.

The glow plugs of Embodiments 301 and 302 and of Comparative Example 303 were evaluated in the same manner to Example 2. The evaluation results are indicated in TABLE 4.

As is apparent from TABLE 4, it has been found that the glow plugs of Embodiments 301 and 302 according to the invention have longer lives and are more reliable than the comparative example.

TABLE 3

| | MATERIALS | | | TIME TO REACH | TEMPERATURE | |
|---|---|---|---|---|---|---|
| | HEATING COIL | COIL | CONTROL COIL | 800° C. (sec) | AFTER 30 sec (° C.) | DURABILITY |
| EMBODIMENT | | | | | | |
| 201 | Fe—Cr Alloy | pure Ni | Sample No. 1 | 4.0 | 900 | A |
| 202 | Fe—Cr Alloy | pure Ni | Sample No. 2 | 4.0 | 900 | A |
| COMPARATIVE EXAMPLE | | | | | | |
| 203 | Fe—Cr Alloy | pure Ni | Sample No. 8 | 4.0 | 900 | B |

TABLE 4

| | MATERIALS HEATING/CONTROL COIL | TIME TO REACH 800° C. (sec) | TEMPERATURE AFTER 30 sec (° C.) | DURABILITY |
|---|---|---|---|---|
| EMBODIMENT | | | | |
| 301 | Sample No. 1 | 13 | 1030 | A |
| 302 | Sample No. 2 | 13 | 1030 | A |
| COMPARATIVE EXAMPLE | | | | |
| 303 | pure Ni | 13 | 1030 | B |

According to the invention, there is provided a glow plug comprising an electric resistor with an excellent quick heating ability, a self-temperature control function. high oxidation resistance and good workability, as described above. It is therefore possible to increase the design freedom of glow plug, at the same time, to provide the glow plug with high performance, long operating lifetime and high reliability.

Although the invention has been described with reference to specific embodiments of the invention, the invention is not limited to the above-described embodiments. Modification and variation of the embodiments described above will occur to those skilled in the art in light of the above teaching. The scope of the invention is defined with reference to the following claims.

What is claimed is:

1. A glow plug having an electric resistor comprising 20 to 60% by weight nickel, less than 5% by weight iron, and the balance being cobalt and unavoidable impurities.

2. The glow plug according to claim 1, wherein the following equation is satisfied: $X+7Y \leqq 70$, where X and Y are the contents of nickel and iron in terms of % by weight, respectively.

3. The glow plug according to claim 1, wherein the unavoidable impurities include 0.1% by weight or less carbon, and 0.1% by weight or less silicon, titanium, manganese. chrome, aluminum, boron and bismuth in total.

4. The glow plug according to claim 1. wherein the electric resistor further comprises 3% by weight or less vanadium, and 3% by weight or less tungsten.

5. The glow plug according to claim 1. wherein the electric resistor further comprises 8% by weight or less molybdenum.

6. The glow plug according to claim 5, wherein the electric resistor further comprises 3% by weight or less vanadium, and 3% by weight or less tungsten.

7. The glow plug according to claim 1, wherein a resistance ratio of $\rho(1000)/\rho(20)$ falls within a range from 7 to 12, where $\rho(20)$ and $\rho(1000)$ are the electrical resistance of the electric resistor at 20° C. and at 1000° C., respectively.

* * * * *